US006244004B1

(12) United States Patent
Timmerman, Sr. et al.

(10) Patent No.: US 6,244,004 B1
(45) **Date of Patent: *Jun. 12, 2001**

(54) LATERAL FORCE RESISTING SYSTEM

(76) Inventors: Timothy L. Timmerman, Sr., 7982 Escobedo Ave.; Timothy L. Timmerman, II, 7210 Lyons Ave., both of Hesperia, CA (US) 92345

( * ) Notice: Subject to any disclaimer, the term of this patent is extended or adjusted under 35 U.S.C. 154(b) by 0 days.

This patent is subject to a terminal disclaimer.

(21) Appl. No.: 09/060,931

(22) Filed: Apr. 14, 1998

Related U.S. Application Data

(60) Provisional application No. 60/043,835, filed on Apr. 14, 1997.

(51) Int. Cl.[7] ..... E04B 1/41

(52) U.S. Cl. ..... 52/274; 52/285.2; 52/285.4; 52/293.3; 52/713; 52/DIG. 11

(58) Field of Search ..... 52/274, 285.2, 52/285.4, 293.3, 713, DIG. 11

(56) References Cited

U.S. PATENT DOCUMENTS 2,689,987 * 9/1954 Berger ..... 52/713 X
3,762,117 * 10/1973 Horvath ..... 52/713 X
4,272,933 * 6/1981 Lopes ..... 52/DIG. 11 X
4,736,554 4/1988 Tyler .
5,402,614 4/1995 Jewell .
5,664,388 9/1997 Chapman et al. .

OTHER PUBLICATIONS

Gary Hardy and Jim Pellon, "Hardy Frame Brochure".
EZ Tech, "Z–Wall Brochure".

* cited by examiner

*Primary Examiner*—Christopher T. Kent
(74) *Attorney, Agent, or Firm*—Irell & Manella LLP

(57) ABSTRACT

A lateral force resisting system includes a rigid structural panel and holdowns. A foundation bolt placement template may be used to locate and support the foundation bolts during fabrication of the foundation and to further secure the frame foundation interface. The rigid structural panel may be a vertical truss or a rigid structural frame with a wooden panel covering one side and interconnecting the members of the rigid structural frame. The wooden panel may be made up of multiple panes to tailor the response of the panel to the lateral force load. The holdowns secure the rigid structural panel to the foundation bolts and may be either a folded strap and pin embodiment or self-tightening.

2 Claims, 16 Drawing Sheets

FIG. 9A
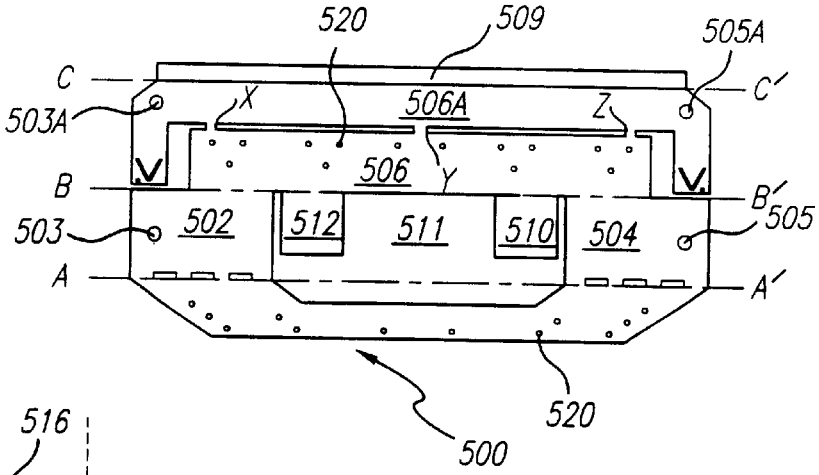
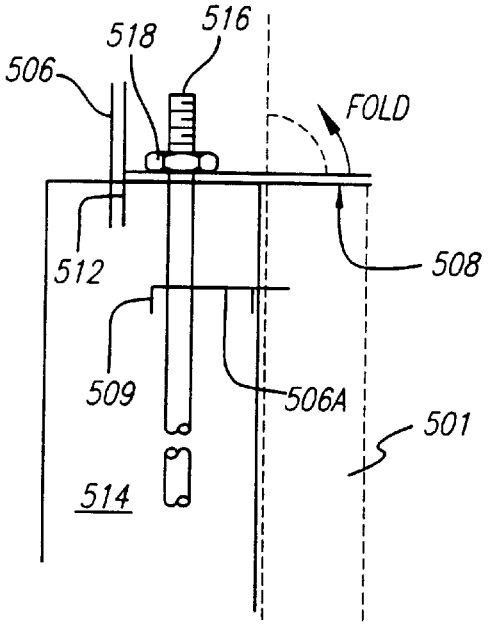
FIG. 9C
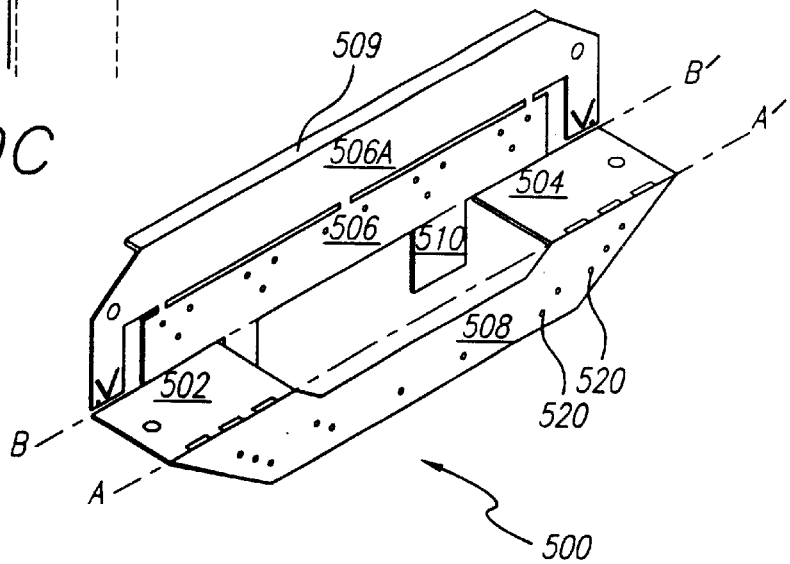
FIG. 9B

FIG. 19A
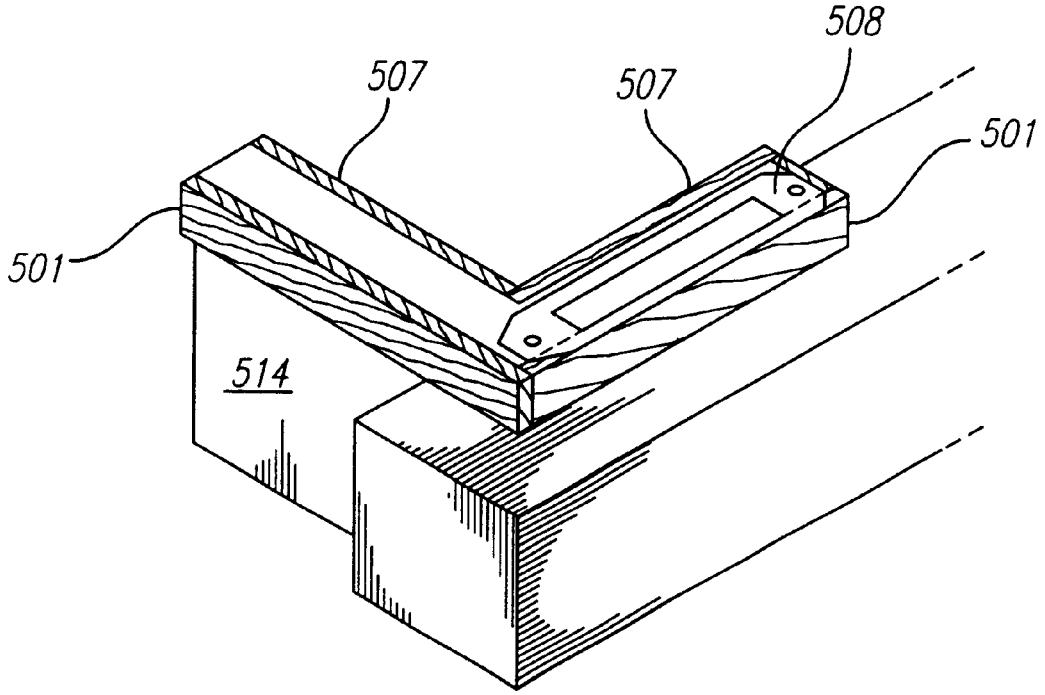
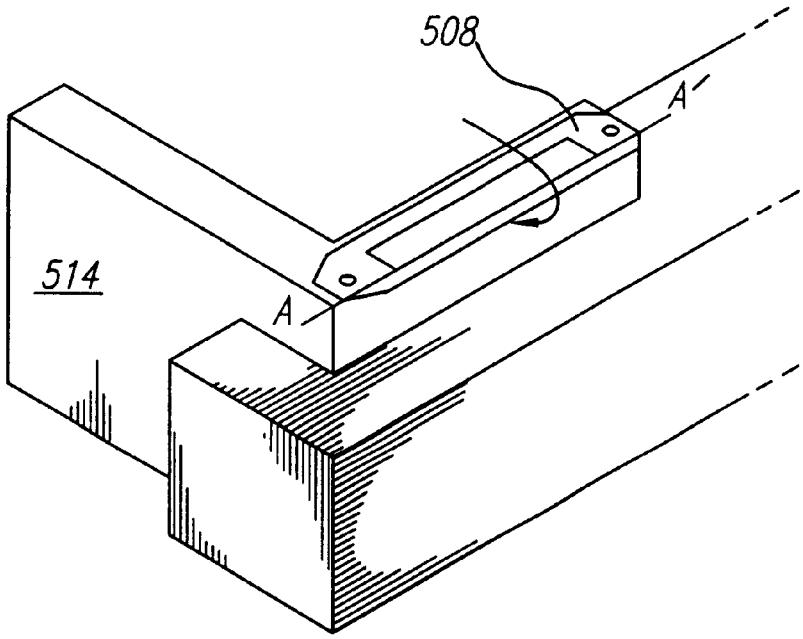
FIG. 19B

FIG. 20A
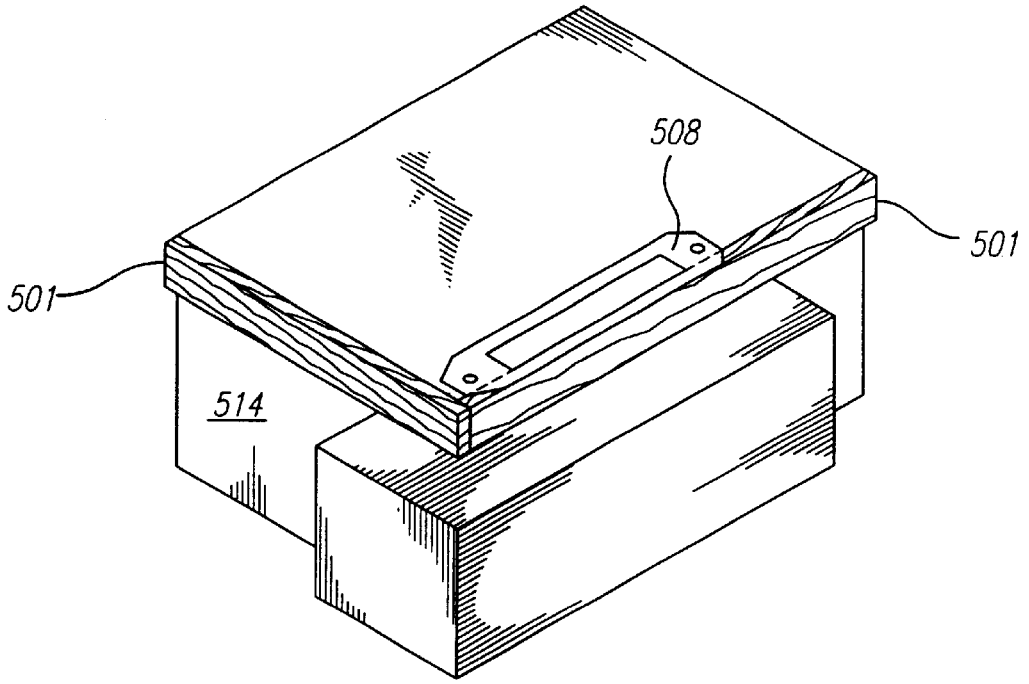
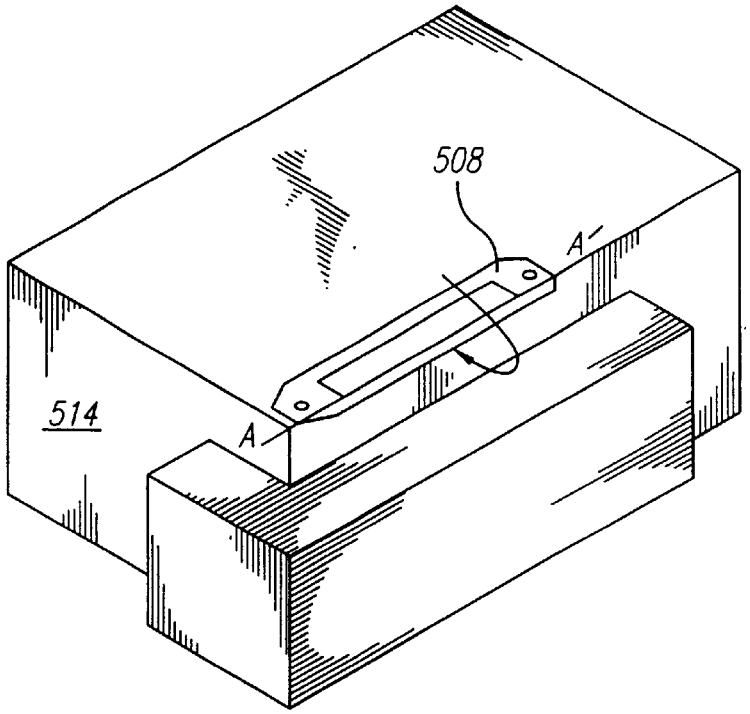
FIG. 20B

LATERAL FORCE RESISTING SYSTEM

RELATED APPLICATIONS

This invention claims priority of copending U.S. provisional patent application Ser. No. 60/043,835 filed Apr. 14, 1997.

BACKGROUND OF THE INVENTION

1. Field of the Invention.

This invention relates generally to the field of building construction and in particular to structural framing elements for building construction.

2. Description of the Prior Art.

The vast majority of buildings are wood frame construction. Wood frame buildings are subjected to many forces. Among the most significant are gravity, wind, and seismic forces. Gravity is a vertically acting force, wind and seismic forces are primarily lateral (horizontal). Many wood frame buildings use shearwall panels to resist lateral loads. A shearwall panel is formed by the application of one or more types of sheathing such as, plywood, fiberboard, particle board, and or drywall (gypsum board), to the inside or outside or both sides of a wall frame. The sheathing is fastened to the wall frame at many points creating a shearwall panel. Many suitable fasteners are available, nails are commonly used and will be referred to hereafter. The sheathed shearwall panel is used to conduct the lateral force acting on the frame of the building to the foundation.

Buildings require a strong base for support. Most buildings have a concrete base that is generally referred to as the foundation. A concrete pad whose top forms a continuous plane from edge to edge is called a slab. With a slab the concrete forms the floor of the building. The deepest concrete support that follows the perimeter of the building is called the footing. In a building without a concrete floor, the floor may be supported by short concrete walls called stem walls that are supported by the footing. Some grading considerations or design requirements necessitate a hybrid of a slab and a stem wall. This results in the use of short concrete walls extending from a few inches to a few feet above the level of the concrete floor. Foundation will be used hereafter in place of stem wall, footing, and slab.

The site where the building is to be erected is first graded (leveled). Wooden boards are nailed together to create a 'form' or mold for the foundation (slab, footing, stem wall). The forms mark the edges of the foundation. Next, wet concrete is poured into the form and the surface is smoothed and the concrete is allowed to harden. As the concrete hardens, bolts are partially imbedded in the top of the foundation with the threaded end of each bolt protruding out of the foundation. The bolts are embedded wherever a wall will contact the foundation/stem wall to provide a means of securing the wall to the foundation.

The frame of the walls is fabricated next. Each wall frame section is composed of several elements. In North America, the wall frames of most homes and small buildings use boards having cross sectional dimensions of 2"×4", 2"×6", or 2"×8". At the base of the wall frame is a board called the mudsill. The mudsill is usually a 2"×4" board chemically treated to resist rotting. The studs are nailed on top of the mudsill. The studs are generally 2"×4" boards standing on end usually 16" apart. On top of the studs is a board called the top plate that is nailed to each stud. The top plate is usually a 2"×4" board. The wall frame is nailed together while all the parts are lying flat on the foundation. Holes are drilled through the mudsill for the foundation bolts to pass through the mudsill. After the wall frame is nailed together, the wall frame is tilted to a vertical orientation. The wall frame is put in its finished location with the foundation bolts protruding through the holes drilled in the mudsill. The wall frame is braced until the adjacent wall frames are in place. Once adjacent wall frames are in place, they are nailed together at the corners and an additional plate (top cap) is added which overlaps the top plates of adjacent wall frames.

Once the wall frames are in place the supports for the ceiling may be attached. The ceiling supports are called ceiling joists, and they rest on and are attached to the walls at the top cap. The joists are parallel to the foundation and span the distance from one wall in a room to the opposite wall in the room. After the ceiling joists are in place, the roof is framed. The roof frame members (rafters) are also attached to the top cap. In many buildings the ceiling joists and the roof framing are combined by the use of trusses. A roof truss is generally triangular and is composed of the roof rafters and the ceiling joists all prefabricated together of usually 2"×4" boards.

After the building frame is completed, the building is ready to be sheathed. Conventional building construction uses sheathing inside a building (drywall) which forms the wall surface which we all see, and sheathing on the roof which helps keep the building dry. Plywood or other sheathing is also applied to the outside and sometimes the inside walls of every building. The panel created by many nails driven through the plywood or drywall into the supporting wall studs, mud sill and top plates creates a sturdy vertical diaphragm known as a sheathed shearwall. Drywall or gypsum sheathing provides insulation and fire resistance and some structural stability. The structural contribution of a drywall panel is limited because of the relatively delicate composition of the drywall. Where higher lateral force resistance is required, builders and designers generally use plywood or particle board or fiberboard sheathing fastened to the wall frame. Plywood is the most common choice and will be used hereafter, but other suitable materials may be used. Plywood is available in 4'×8' sheets that vary from ¼" to over 1" in thickness. Plywood is composed of many thin layers of wood glued together under pressure with the grain pattern of adjacent layers perpendicular to each other for strength.

Review of damage following the Northridge earthquake, revealed that many plywood sheathed shearwalls failed under the seismic forces. The nailing of the sheathing in the field during construction leads to many failures. Nails driven through the sheathing miss the frame member they were intended to penetrate creating 'shiners'. Nail heads penetrate the skin of the sheathing during nailing which weakens the sheathing and allows the nails to be pulled through the sheathing under load conditions as well as inducing failures in the integrity of the sheathing. Shearwall fabrication requires regular nail spacing of 3"–12" depending on the design requirements. Current field fabrication techniques are not sufficiently accurate to consistently meet the design specifications. Therefore every shearwall panel may be nailed differently and many may be installed with fewer nails than required to handle the required design load.

The rise in land prices has caused the building of more multiple floor dwellings to raise housing density. Multiple floors significantly increase lateral loads and thus increase the use of field fabricated sheathed shearwalls. In many multiple story buildings the entire outside of the building may be sheathed.

Consequently many of the building departments in California are limiting sheathed shearwalls to a maximum height/width ratio of 2:1. Where walls are typically eight feet high, the minimum shearwall width would be four feet. This restriction has implications throughout a building. At the front of a garage narrow shearwalls, two to three foot wide, are common. Narrow sheathed shearwalls are also common adjacent to window and door openings.

The interface between the shearwall and the foundation may also be area of weakness. The conventional practice of locating holdowns within the framework of a sheathed shearwall weakens the sheer wall and the frame-foundation interface. Bolts imbedded in the concrete of the foundation provide attachment points for the walls and shear panels. These bolts are intended to pass through the mudsill of the sheathed shearwall to prevent lateral movement between the sheathed shearwall and the foundation. The foundation bolts also transfer the lateral load from the top of the sheathed shearwall to the foundation. Quite often the bolts which are supposed to secure the walls and shear panels are placed several inches away from where they are required for optimum load transfer and ease of wall construction due to inaccurate measuring and carelessness during field installation of the bolts. The resulting misalignment forces some of the framing members to be trimmed to fit, or in some cases, the intended foundation bolt must be cut off and a "redhead" must be used. A "red head" is a bolt forced into a hole drilled into the foundation. The resulting attachment of the wall to the foundation is a potential point of failure.

Another common fabrication error is oversize holes in the mudsill. The mudsill is the base member of a wall frame that is in direct contact with the foundation. Inaccurate measuring and carelessness in drilling the mud sill during framing of the walls often result in holes in the mud sill which don't line up with the bolts placed in the foundation or in the stem wall. This requires extra holes, or oversize or elongated holes be created in the mud sill which weakens the frame-foundation interface.

The steel attachment hardware that connects the shearwall to the foundation is another point of weakness. If a field fabricated shearwall was ever built in exact compliance with the design, the steel attachment hardware would likely fail before the shearwall. In most cases the steel attachment hardware is fabricated by folding steel strips with a few tack welds. In practice the folds provide the necessary flex in the steel attachment hardware to induce failure. In other cases, the method of attaching the steel attachment hardware to the studs induces cracking of the studs.

Some developers and building departments have been examining the feasibility of using "metal studs" to create the frame of a building. This has the benefit of simpler fabrication. The elements of the wall frame are attached to each other with sheet metal screws or other suitable fasteners, and the metal studs do not split like many boards do when fasteners are driven into them. The metal studs may be cut to exact size with metal shears eliminating the need for dangerous power saws. The metal studs have holes fabricated in them to accommodate electric wiring eliminating the need to drill holes through wooden members wherever wiring is needed. Metal studs alone are not very strong compared to wood, however, metal studs are less expensive than wood. Their advantage is that when the metal studs are used to create a vertical diaphragm or panel by the application of sheathing the resulting panel may support almost as much vertical load as its wooden counterpart at a fraction of the cost.

SUMMARY OF THE INVENTION

In accordance with the present invention, lateral force resistance of a building frame is improved by substituting a lateral force resisting system, which includes a rigid structural panel and holdowns in place of each conventional sheathed shearwall. In addition, a foundation bolt placement template may also be used. The elimination of in-field fabrication of sheathed shearwalls will provide greater uniformity in building construction and greater lateral force resistance through elimination of attachment problems in sheathed shearwalls and an improved frame-foundation interface. The lateral force resisting system may be used in wood frame as well as metal frame buildings.

The rigid structural panel may be compatible with standard North American framing dimensions, that is, framing members having 2"×4", 2"×6", 2"×8" cross section dimensions. In one aspect of the present invention, a vertical truss may be used as the rigid structural panel, however other configurations may be used with suitable results.

A foundation bolt placement template improves the lateral load transfer across the frame-foundation interface. The foundation bolt placement template provides a means to accurately locate the foundation bolts before pouring the concrete for the foundation. The foundation bolts, which secure the rigid structural panel to the foundation, may be accurately located on the foundation and the bolts may be easily set to protrude the correct distance out of the foundation. Use of a foundation bolt placement isolates the vertical elements of the rigid structural panel from the foundation thus it is not necessary for any of the vertical elements of the rigid structural panel to be treated to resist rotting.

In another aspect of the present invention, securing tabs of the foundation bolt placement template may be captured within the wet concrete of the foundation. The foundation bolt placement template minimizes obstruction of the concrete form during fabrication of the foundation. Thus, wet concrete may be poured through the center of the foundation bolt placement template. After the foundation concrete has dried, the outside plate of the foundation bolt placement template may be folded up to form a channel to accommodate the sill plate and side members of the truss. The inside and outside plates of the foundation bolt placement template have fastener attachment points to further secure the rigid structural panel at the frame-foundation interface.

In another aspect of the present invention, the inside and/or outside plates of the foundation bolt placement template are temporarily secured to the forms to accurately locate the foundation bolts. After the forms are removed, both the inside and outside plates may be folded up to further secure the rigid structural panel. In a further aspect of the present invention, the foundation bolt placement template includes a bolt spacing tab that is separated from the foundation bolt placement template and attached to the inside of the form before the concrete is poured. The bolt spacing tab is located directly below the foundation bolt placement template to maintain a vertical orientation of the foundation bolts.

In a still further aspect of the present invention, holdowns secured to the rigid structural panel further secure the rigid structural panel to the foundation. The holdowns engage the foundation bolts outside the boundaries of the rigid structural panel. Therefore, sources of weakness at the frame-foundation interface due to holes in the mudsill of the rigid structural panel are minimized. There are no elongated or extra holes through the sill plate, and no interference between the holdown, the foundation bolts, and wall frame members. In another still further aspect of the present invention, the holdown has improved load capacity over conventional devices with minimal deformation, and thus improved resistance to cyclic loads over conventional devices. The holdown is sized to fit within the cross sectional space of a wall frame member. When a holdown is installed, a wall frame member, 2"×4", 2"×6", or 2"×8", as appropriate may be used to furr the side of the rigid structural panel above the holdown, and completely shade the holdown, thus allowing the lateral force resisting system to be easily integrated into conventional building framing. In a currently preferred embodiment of the present invention, the holdown generally resembles a slotted, folded metal strap capturing a metal pin in the fold. The metal pin has a transverse hole that accommodates a holdown screw. The holdown screw extends perpendicularly from the metal pin through a slot in the metal strap and engages a foundation bolt through a coupling nut that simultaneously engages the threads of the holdown screw and the foundation bolt. A lock nut may be used to tighten against the coupling nut to prevent the coupling nut from loosening.

In a still further aspect of the present invention, the holdown may be self-tightening. The holdown is generally wedge shaped with spring propelled side wedges which will cause the holdown to self-tighten during cyclic lateral force loading if the structural panel begins racking.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 9(*a*) is a top view of a currently preferred embodiment of a foundation bolt placement template according to the present invention.

FIG. 9(*b*) is a perspective view of the foundation bolt placement template of FIG. 9(*a*).

FIG. 9(*c*) is an end view of the foundation bolt placement template of FIG. 9(*a*).

FIG. 17(*b*) is an exploded perspective view of the self-tightening holdown of FIG. 17(*a*).

FIG. 19(*a*)–(*b*) are perspective views of a stem wall foundation corner according to one aspect of the present invention.

FIG. 20(*a*)–(*b*) are perspective views of a slab foundation corner according to a second aspect of the present invention.

DETAILED DESCRIPTION OF THE PREFERRED EMBODIMENT(S)

Figure 1:
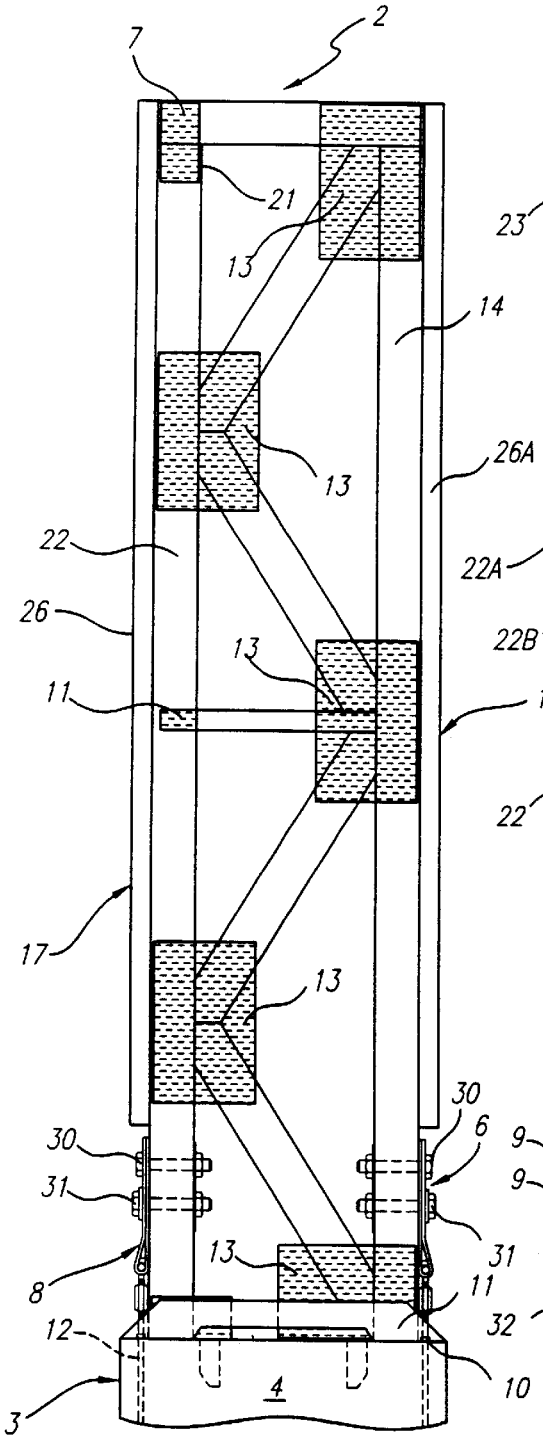
FIG. 1 is a front view of a first embodiment of the present invention.
Figure 4:
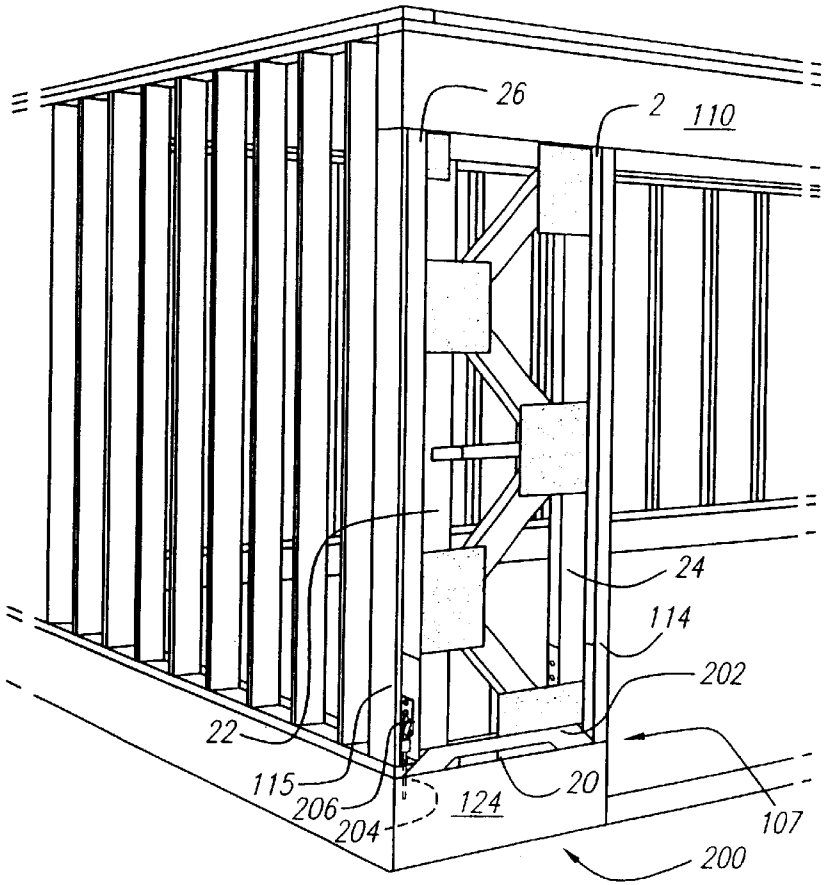
FIG. 4 is a perspective view of FIG. 1 embodiment of the present invention integrated in a building frame as a replacement for a section of a sheathed shearwall.

FIG. 1 is a front view of a currently preferred embodiment of the present invention, showing rigid structural panel 2, secured to foundation 4, by foundation bolt placement template 14 and holdowns 6 and 8 engaged to foundation bolts 10 and 12 respectively. Furring boards 26 and 26A are attached to first side member 22 and second side member 24 respectively. As shown in FIG. 4, furring boards 26 and 26A enable stud 115 and trimmer 114 to be solidly attached at side 17 and side 19 respectively.

Figure 2:
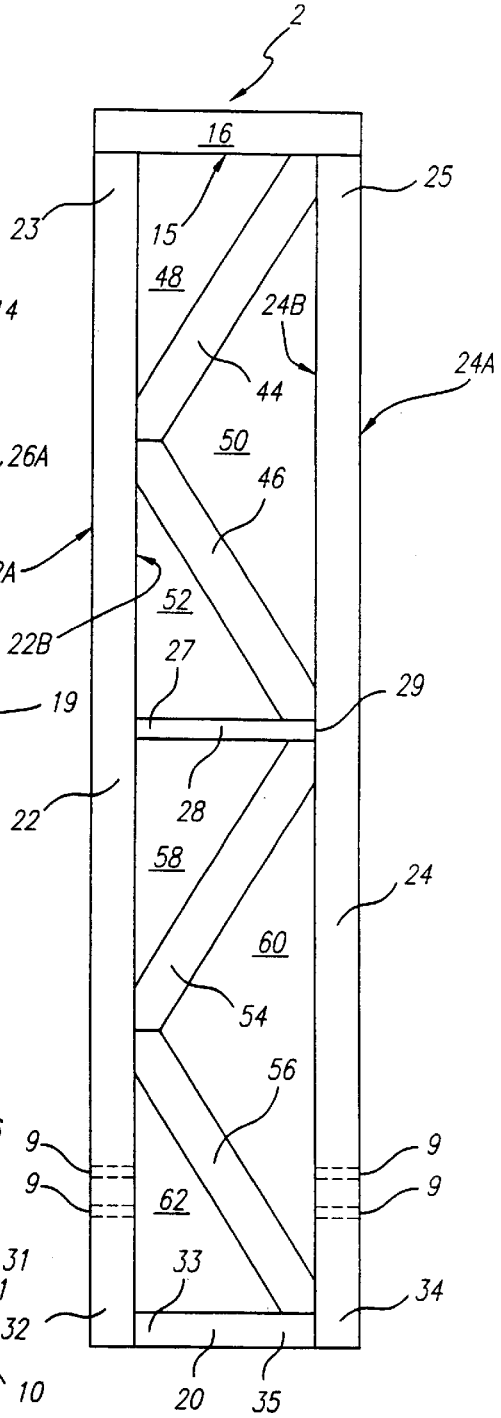
FIG. 2 is a front view of an embodiment of a rigid structural frame.

Referring now to FIG. 2, a front view of one aspect of the present invention is shown. Rigid structural panel 2 is configured as a vertical truss for applications requiring a 1–3½ foot wide lateral force resistance panel. Sill plate 20 forms the base of rigid structural panel 2. Sill plate 20 is perpendicular to first side member 22. First side member 22 is parallel to second side member 24. First end 33 of sill plate 20 abuts bottom end 32 of first side member 22. Second end 35 of sill plate 20 abuts bottom end 34 of second side member 24. Top member 16 is perpendicular to first side member 22 and second side member 24. Bottom side 15 of top member 16 abuts top end 23 of first side member 22, and bottom side 15 similarly abuts top end 25 of second side member 24. Horizontal spacing member 28 is approximately equidistant between top member 16 and sill plate 20. First end 27 and second end 29 of horizontal spacing member 28 abut first side member 22 and second side member 24 respectively. Within the rectangle formed by top member 16, first side member 22, second side member 24 and horizontal spacing member 28, are a plurality of web members which form structural support triangles. First web member 44 and second web member 46 form structural support triangles 48, 50, and 52. Within the rectangle formed by sill plate 20, first side member 22, and horizontal spacing member 28, and second side member 24 are web member 54 and web member 56, which form triangles such as structural support triangles 58, 60, and 62.

Rigid structural panel 2 includes horizontal spacing member 28, however a suitable rigid structural panel may not include a horizontal spacing member. Horizontal spacing member 28 simplifies the fabrication of the rigid structural panel by bracing the vertical side members during fabrication. The horizontal dimensions of rigid structural panels fabricated with a horizontal spacing member(s) 28 are more consistent because a bow in first side member 22 or in second side member 24 may be removed during fabrication.

In another aspect of the present invention, near bottom end 32 of first side member 22 and bottom end 34 of second side member 24, are transverse holes 9, parallel to sill plate 20. Holes 9 accept bolts such as bolt 30 for attaching holdowns such as holdown 6 and holdown 8 as shown in FIG. 1.

Figure 3:
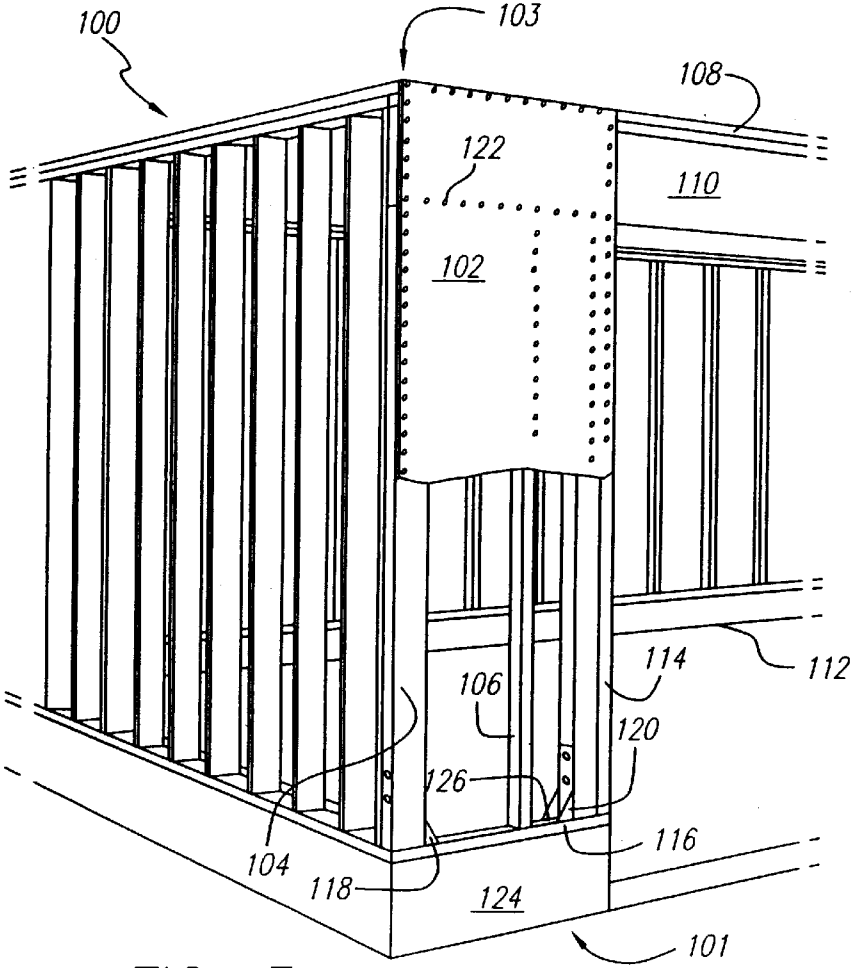
FIG. 3 PRIOR ART
FIG. 3 is a perspective view of the prior art wood framing techniques showing the elements of a building frame and a section of a sheathed shearwall.

Referring now to FIG. 3, building frame 100 is an example of conventional building framing. Shearwall 101 is formed by fastening sheathing 102 to corner post 104, stud 106, top cap 108, header 110, post 112, trimmer 114 and mud sill 116. Sheathing 102 may be fastened to frame members 104–116 in any conventional manner such as nails or screws. A plurality of fasteners 122 attach sheathing 102 to frame members 104–116, at regular intervals along frame members 104–116 and along periphery 103 of sheathing 102. Holdowns 118 and 120 are secured to corner post 104 and post 112, respectively, within shearwall 101. Holdown 118 and 120 are secured to foundation 124 by a bolt, such as bolt 126, shown penetrating holdown 120 and mud sill 116.

Referring now to FIG. 4, the present invention is shown as a replacement for shearwall 101. In this embodiment, rigid structural panel 200 is configured as a vertical truss and provides vertical support for header 110. Foundation bolt placement template 202 locates and supports foundation bolts such as bolt 204 during fabrication of foundation 124. Foundation bolt placement template 202 also attaches to sill plate 20, bottom end 32 of first side member 22, and bottom end 34 of second side member 24 to further secure frame-foundation interface 107. Two holdowns such as holdown 206 are attached to the outside of panel 200 to further secure panel 200 to foundation 124.

Figure 5:
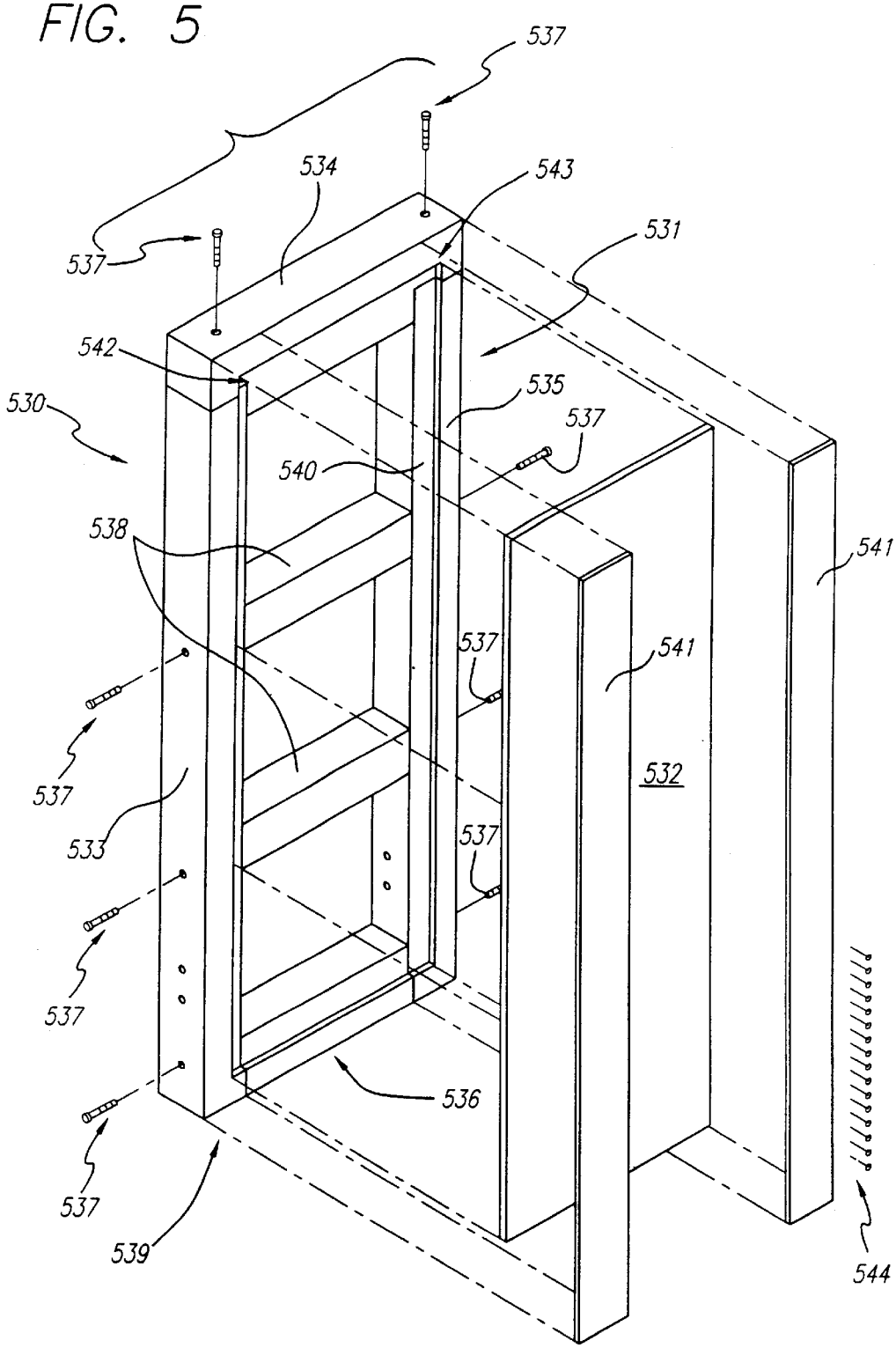
FIG. 5 is a perspective view of a second embodiment of a rigid structural panel.

Referring now to FIG. 5, in a currently preferred embodiment of the present invention rigid structural panel 530 is configured as a generally rectangular frame 531 covered on side 539 by a panel 532. In this configuration first vertical side member 533 and second vertical side member 535 are connected by top end 534 and bottom end 536. The interior opening may be divided by one or more interior dividers 538. The elements of rectangular frame 531 are connected together by any conventional connector, here bolts 537 are used. Panel 532 is attached to side 539 using any conventional fasteners. In a currently preferred embodiment of the present invention panel 532 is an oriented strand board (OSB) panel and is inset into dado 540 in rectangular frame 531. Plates 541 are fastened over joints 542 and 543 formed between panel 532 and frame 531. Any conventional fastener 544 may be used to attach plates 541, here fasteners 544 are #10 common galvanized nails are every 4". In a currently preferred embodiment of the present invention plates 541 are 20 gauge galvanized steel however, other suitable materials may be used.

Figure 6:
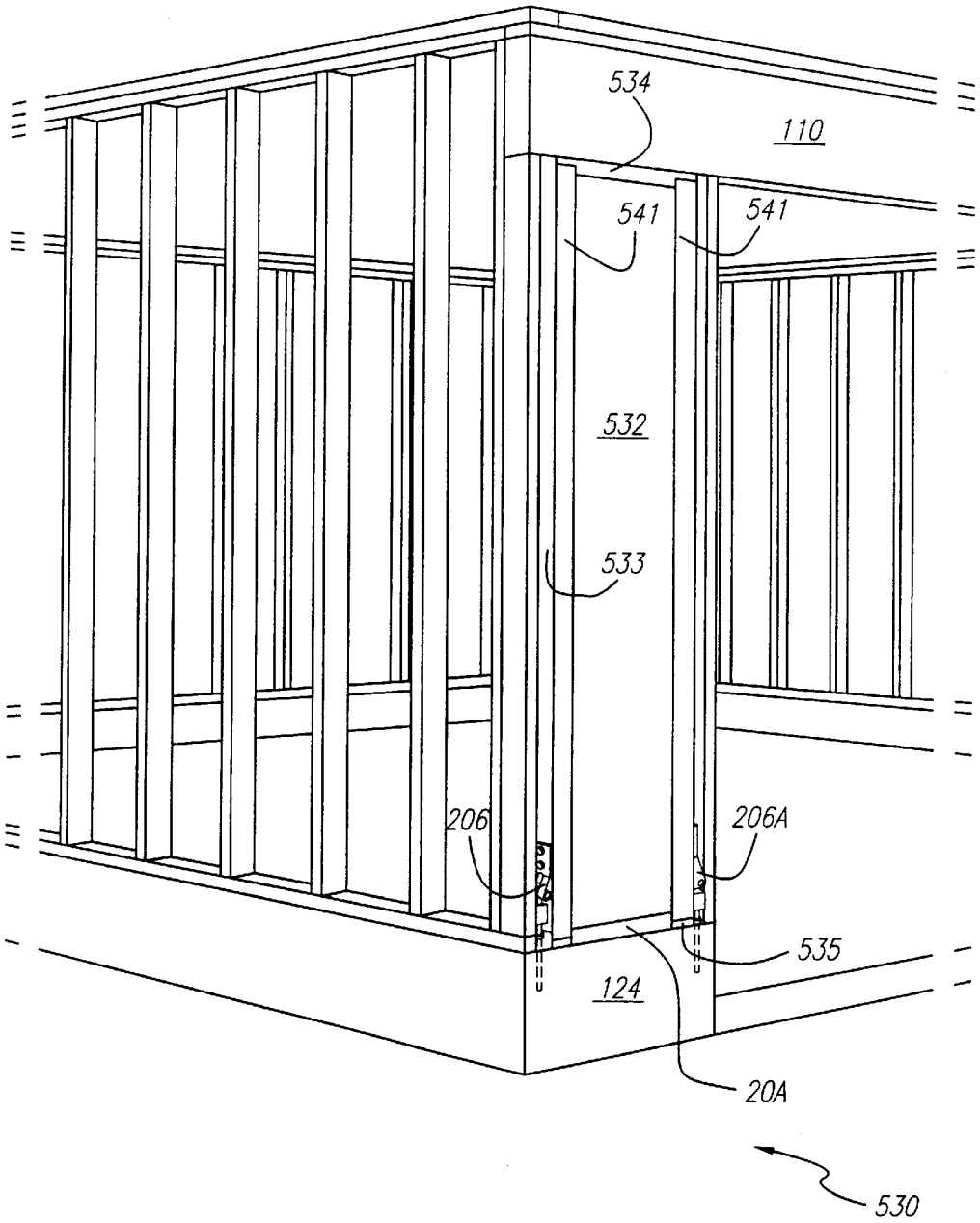
FIG. 6 is a perspective view of FIG. 5 embodiment of the present invention integrated in a building frame as a replacement for a section of a sheathed shearwall.

Referring now to FIG. 6, the present invention is shown as a replacement for shearwall 101. In this embodiment, rigid structural panel 530 provides vertical support for header 110. Holdowns 206 and 206A are attached to first vertical side member 533 and second vertical side member 535 respectively, to secure rigid structural panel 530 to foundation 124. rigid structural panel 530 may be secured to foundation 124 without the use of a foundation bolt placement template.

Figure 7:
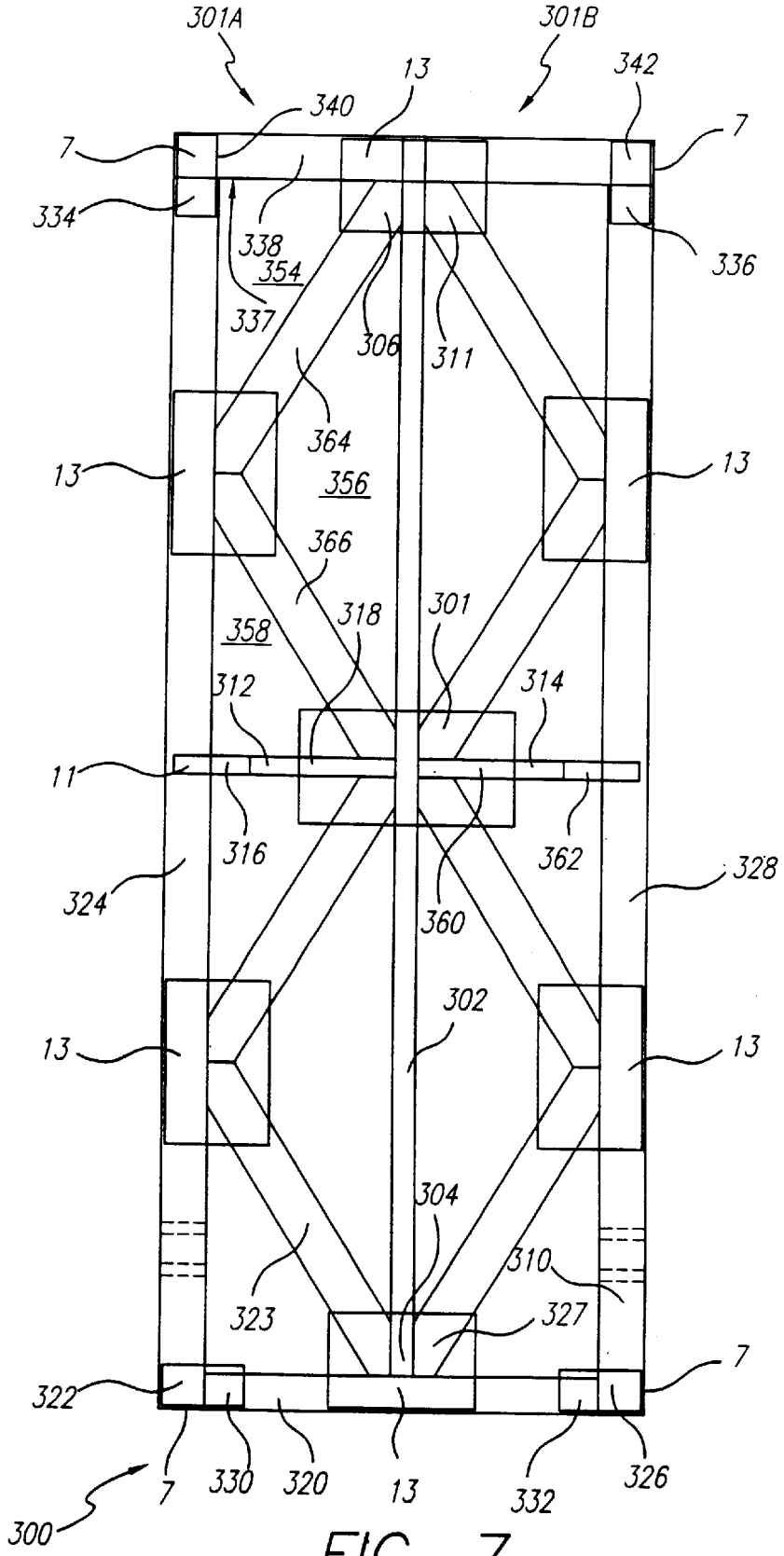
FIG. 7 is a front view of an alternate embodiment of a rigid structural panel.

Referring now to FIG. 7, another aspect of the present invention is shown in which rigid structural panel 300 is configured for applications requiring a 3½–6½ foot wide lateral force resistance panel. Rigid structural panel 300 includes sill plate 320, perpendicular to first side member 324, first end 330 of sill plate 320 abuts side 323 of bottom end 322 of first side member 324. Sill plate 320 is also perpendicular to second side member 328, second end 332 of sill plate 320, abuts side 327 of bottom end 326 of second side member 328. First side member 324 is parallel to second side member 328. Vertical support 302 is perpendicular to sill plate 320, bottom end 304 of vertical support 302 abuts top center 310 of sill plate 320. Top member 338 is perpendicular to first side member 324, bottom side 337 of first end 340 of top member 338, abuts top end 334 of first member 324. Top member 338 is perpendicular to vertical support 302, bottom point 311 of top member 338 abuts top end 306 of vertical support 302. Top member 338 is also perpendicular to second side member 328, bottom side 337 of second end 342 abuts top end 336 of second side member 328. Horizontal spacing member 312 is about equidistant between sill plate 320 and top member 338. First end 316 of horizontal spacing member 312 abuts first side member 324 and second end 318 of horizontal spacing member 312 abuts vertical support 302. Horizontal spacing member 314 is about equidistant between sill plate 320 and 338. First end 360 of horizontal spacing member 314 abuts vertical support 302 and second end 362 of horizontal spacing member 314 abuts second side member 328. A plurality of rectangles are formed by the arrangement of first side member 324, second side member top member 338, second side member 328, sill plate 320, vertical support 302 and horizontal spacing members 312 and 314. Within each rectangle thus formed, are a plurality of web members forming structural triangles. For example, within the rectangle formed by first side member 324, top member 338, vertical support 302 and spacing member 312 are web members 364 and 366 which form triangles such as structural triangles 354, 356 and 358. The angular orientation of adjacent web members, and the orientation of web members in adjacent rectangles alternates as shown.

In an alternate embodiment, vertical support 302 may be a 4"×4" member. Rectangle 301A formed by first side member 324, top member 338, vertical support 302 and sill plate 320 is covered by a panel 532. Adjacent rectangle 301B formed by second side member 328, top member 338, vertical support 302 and sill plate 320 is covered by a panel 532.

Rigid structural panel 300 may include a plurality of horizontal spacing members such as horizontal spacing members 312 and 314. The addition of horizontal spacing members 312 and 314 simplifies the fabrication of the rigid structural panel by bracing first and second side members 324 and 328 and vertical support 302 during fabrication. The horizontal dimension of a rigid structural panel is more consistent using horizontal spacing members 312 and 314, because a bow in first side member 312, or in second side member 314, or in vertical support 302 may be removed during fabrication. Horizontal spacing members may be included and secured as shown in FIG. 5.

Figure 8:
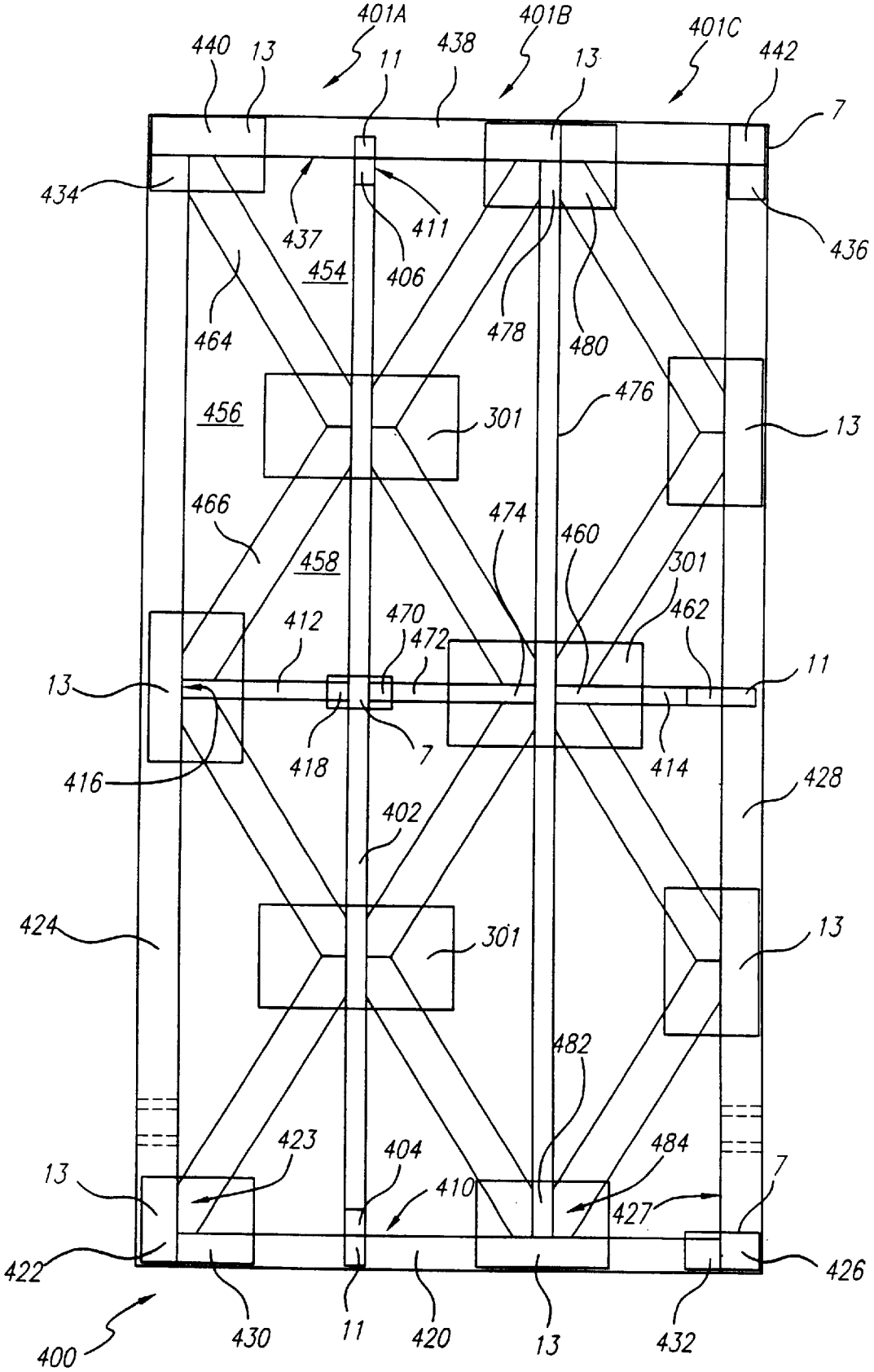
FIG. 8 is a front view of another alternate embodiment of a rigid structural panel.

Referring more specifically to FIGS. 1,7, and 8, in another aspect of the present invention, every joint such as joint 21 of rigid structural panel 2, where two or more members join, a truss plate or gang nail plate, such as truss plate 7 is pressed into each face of the joint which is common to all the members of the joint, that is, the front and back of the joint, to secure the joint. A 20 Ga. truss plate such as plates 7 and 11 is used for joints of only two members. A joint of three or four members uses an 18 Ga. truss plate such as plate 13. A joint of five or more members uses a 16 Ga. truss plate such as plate 301 of FIGS. 7 and 8.

Referring now to FIG. 8, another aspect of the present invention is shown in which rigid structural panel 400 is configured for applications requiring a 5½–8½ foot wide lateral force resistance panel. Rigid structural panel 400 includes sill plate 420, perpendicular to first side member 424, first end 430 of sill plate 420 abuts side 423 of bottom end 422 of first side member 424. Sill plate 420 is also perpendicular to second side member 428, second end 432 of sill plate 420, abuts side 427 of bottom end 426 of second side member 428. First side member 424 is parallel to second side member 428. Vertical support 402 is perpendicular to sill plate 420, bottom end 404 of first vertical support 402 abuts top point 410 of sill plate 420. Second vertical support 476 is perpendicular to sill plate 420 bottom end 482 of second vertical support 476 abuts top point 484 of sill plate 420. Top member 438 is perpendicular to first side member 424 bottom side 437 of first end 440 of top member 438, abuts top end 434 of first side member 424. Top member 438 is perpendicular to first vertical support 402 bottom point 411 of top member 438 abuts top end 406 of first vertical support 402. Top member 438 is perpendicular to second vertical support 476 bottom point 480 of top member 438 abuts top end 478 of second vertical support 476. Top member 438 is also perpendicular to second side member 428 bottom side 437 of second end 442 abuts top end 436 of second side member 428. Horizontal spacing members 412, 472, and 414 are about equidistant between sill plate 420 and top member 438. First end 416 of horizontal spacing member 412 abuts first side member 424, and second end 418 of horizontal spacing member 412 abuts first vertical support 402. First end 470 of horizontal spacing member 472 abuts first vertical support 402, and second end 474 of horizontal spacing member 472 abuts second vertical support 476. First end 460 of spacing member 414 abuts second vertical support 476, and second end 462 of spacing member 414 abuts second side member 428. A plurality of horizontally adjacent rectangles are formed by the arrangement of first side member 424, second side member top member 438, second side member 428, sill plate 420, first vertical support 402 and horizontal spacing members 412 and 414. Within each rectangle thus formed, a plurality of web members form structural triangles. For example, within the rectangle formed by first side member 424, top member 438, first vertical support 402 and spacing member 412 are web members 464 and 466 which form triangles such as structural triangles 454, 456 and 458.

In an alternate embodiment, vertical supports 402 and 476 may be 4"×4" members. Rectangle 401A formed by first side member 424, top member 438, vertical support 402 and sill plate 420 is covered by a panel 532. Horizontally adjacent rectangle 401B is formed by vertical support 476, top member 338, vertical support 402 and sill plate 420 is covered by a panel 532. Rectangle 401C formed by second side member 428, top member 438, vertical support 476 and sill plate 420 is covered by a panel 532.

Rigid structural panel 400 may include a plurality of horizontal spacing members such as horizontal spacing members 412, 414 and 472. The addition of horizontal spacing members 412, 414 and 472 simplifies the fabrication of the rigid structural panel by bracing first and second side members 424 and 428 and vertical supports 402 and 476 during fabrication. The horizontal dimension of a rigid structural panel is more consistent using horizontal spacing members 412, 414 and 472, because a bow in first side member 412, or in second side member 414, or in vertical support 402 or 476 may be removed during fabrication. Horizontal spacing members may be included and secured as shown in FIG. 5.

Figure 10:
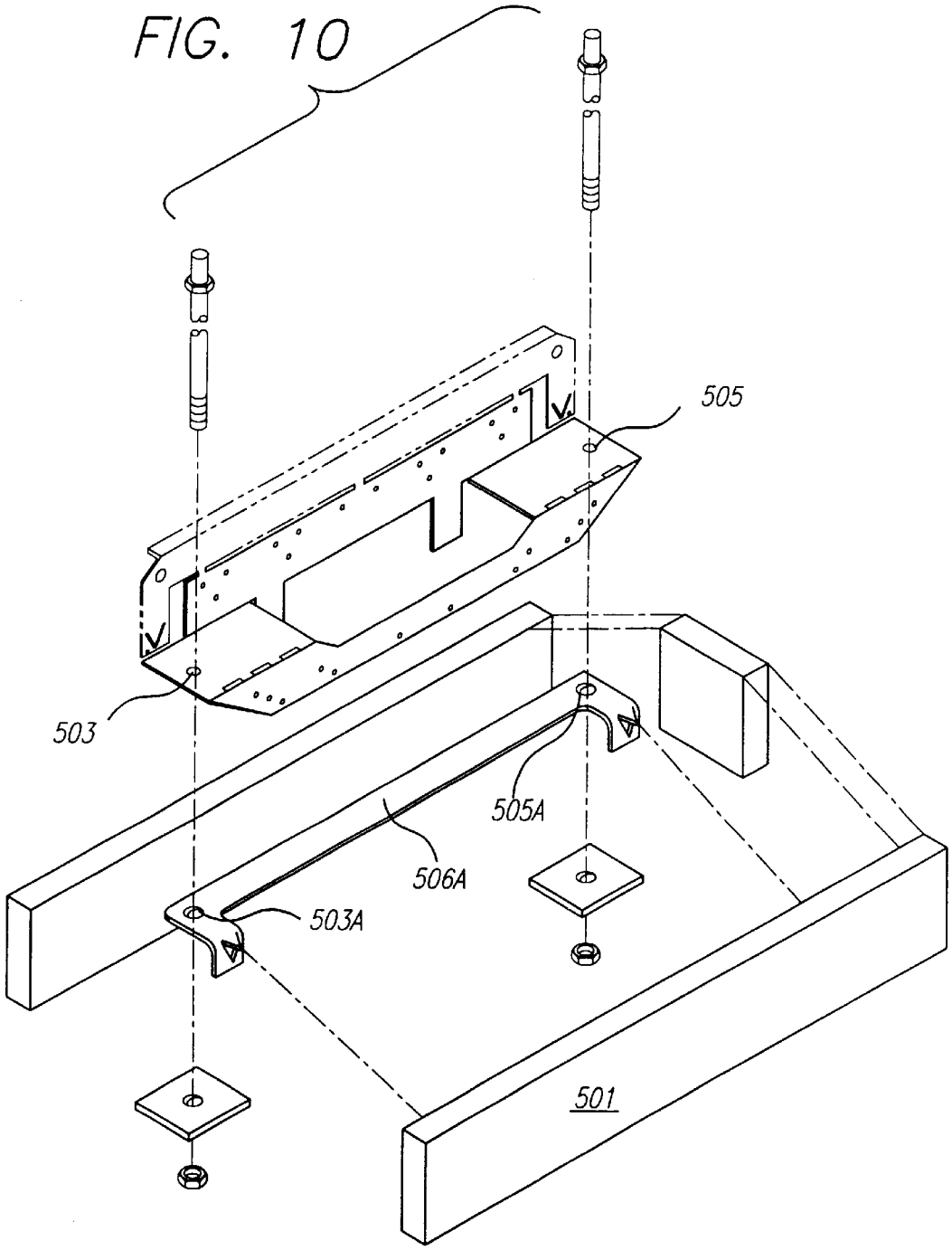
FIG. 10 is an exploded perspective view of the foundation bolt placement template of FIGS. 9(*a*)–(*c*) showing the installation.

Referring now to FIGS. 9(*a*)–(*c*), foundation bolt placement template 500 is one aspect of the present invention. Foundation bolt placement template 500 includes bolt platforms 502 and 504, inside plate 506, outside plate 508 and securing tabs 510 and 512 and bolt spacing tab 506A. Bolt platforms 502 and 504 are generally horizontal and include holes 503 and 505 respectively. Bolt spacing tab 506A includes holes 503A and 505A. Holes 503 and 505 are provided to hang foundation bolts such as bolt 516 through bolt platforms 502 and 504, supported by foundation bolt nuts such as nut 518, during fabrication of foundation 514. Holes 503A and 505A are provided to locate foundation bolts such as bolt 516 during fabrication of foundation 514. Bolt spacing tab 506A is separated from foundation bolt placement template 500 at separation points X, Y, and Z. Flap 509 is folded about 90° along fold line C–C'. Bolt spacing tab 506A is secured to form 501 as shown in FIG. 10. A bolt hung through hole 503 and 503A, or 505 and 505A will be controlled during concrete pouring an remain vertical. Bolt platforms 502 and 504 are separated by concrete access 511 which allows wet concrete to be easily poured through foundation bolt placement template 500 during fabrication of foundation 514. Outside plate 508 foldably joins bolt platforms 502 and 504 along indented and perforated fold line A–A'.

A plurality of fastener points 520 on outside plate 508 allow foundation bolt placement template 500 to be temporarily fastened to outside form 501 (also shown in FIGS. 19(*a*)–(*b*) and 20(*a*)–(*b*) below) during fabrication of foundation 514. Temporary attachment of foundation bolt placement template 500 to outside form 501 allows accurate placement of foundation bolt placement template 500 which supports foundation bolts such as bolt 516. Securing tabs 510 and securing tab 512 are captured within the wet concrete of foundation 514 during fabrication of foundation 514 and provide lateral force resistance at the frame-foundation interface after foundation 514 has hardened. After foundation 514 has hardened, temporary fasteners securing foundation bolt placement template 500 to outside form 501 may be removed to allow outside form 501 to be removed. Outside plate 508 may be folded about 90° along indented and perforated fold line A–A'. A rigid structural panel such as rigid structural panel 2 or 530 may be secured between inside plate 506 and outside plate 508 using a plurality of fasteners (not shown) through fastener points such as fastener point 520. Inside plate 506 is perpendicular to bolt platforms 502 and 504 and joins bolt platforms 502 and 504 along inside edge B–B'.

Figure 11:
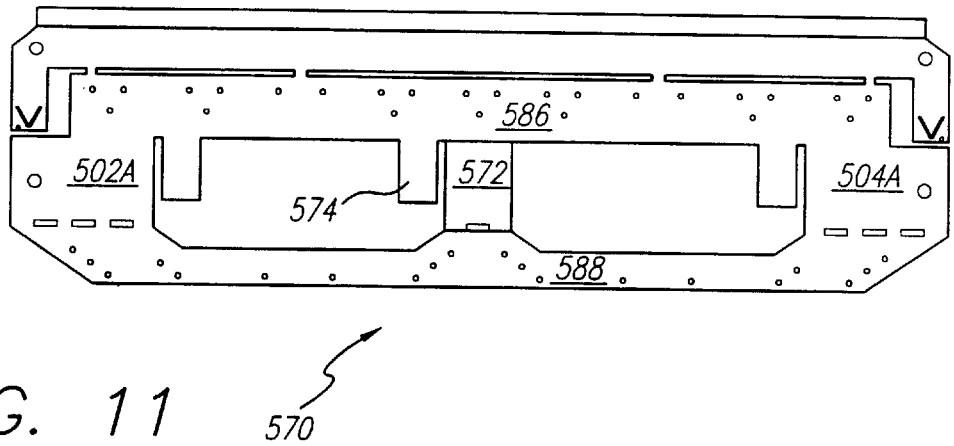
FIG. 11 is a top view of an alternate embodiment of a foundation bolt placement template according to the present invention.
Figure 12:
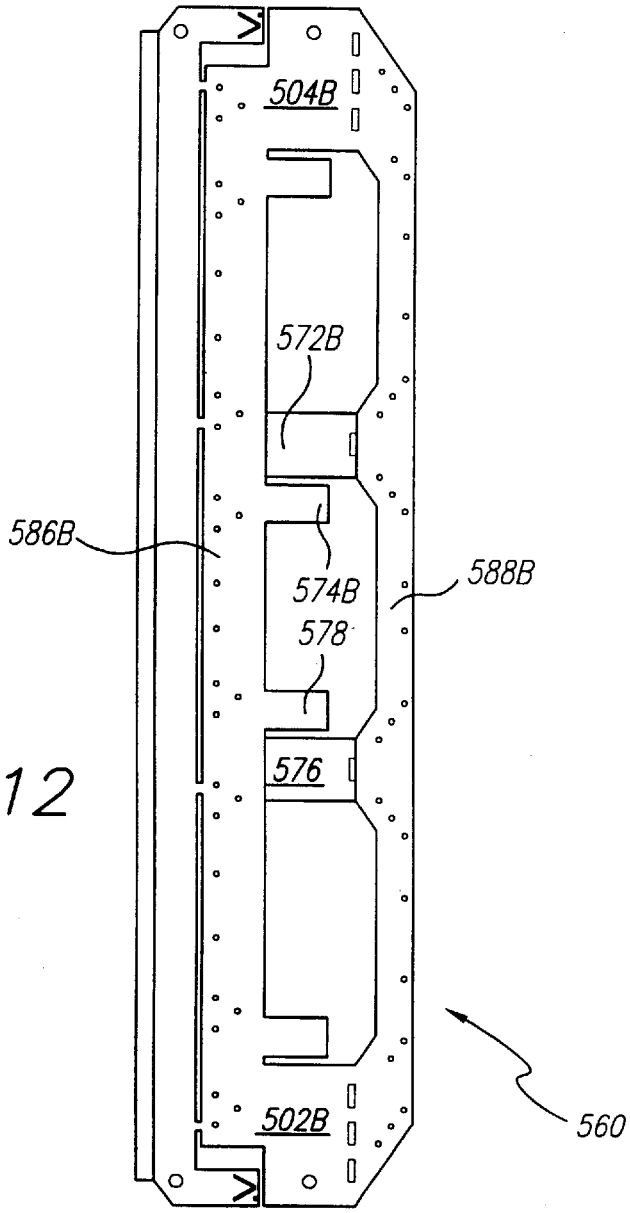
FIG. 12 is a top view of another alternate embodiment of a foundation bolt placement template according to the present invention.

Referring now to FIGS. 11 and 12, foundation bolt placement templates 560 and 570 illustrate templates necessary to accommodate the wider lateral force resistance panels shown in FIGS. 7 and 8. As structural panels get wider a tie plate and adjacent securing tab are added for each vertical support in the panel. To accommodate rigid structural panel 300 tie plate 572 and securing tab 574 added. Tie plate 572 is added to connect inside plate 586 and outside plate 588 and to isolate vertical support 302 from the foundation. For the wider rigid structural panel 400,tie plates 572B and 576 and securing tabs 574B and 578 are added. The added securing tabs provide increased resistance to shear forces at the frame foundation interface.

Figure 15B:
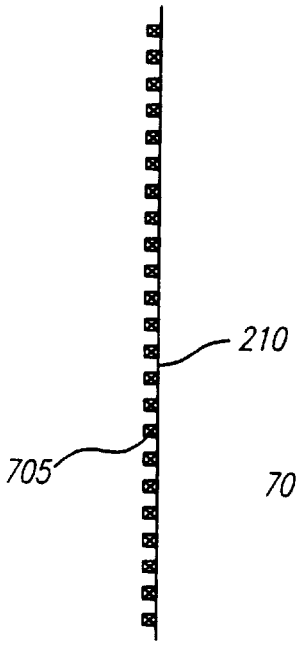
FIG. 15(*a*)–(*b*) are two views of a reinforcing plate showing the bolt holes and the teeth.
Figure 15A:
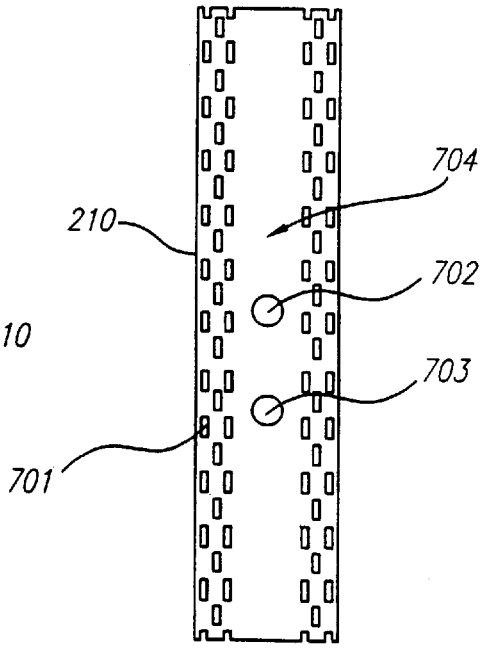

Referring now to FIGS. 15(*a*)–(*b*), reinforcing plate 700 is fabricated to have a plurality of teeth such as tooth 705 to secure reinforcing plate 700 in place. Punches such as punch 701 are made in reinforcing plate 700 to create teeth such as tooth 705. Area 704 adjacent to holes 702 and 703 respectively is free of punches 701.

Figure 13:
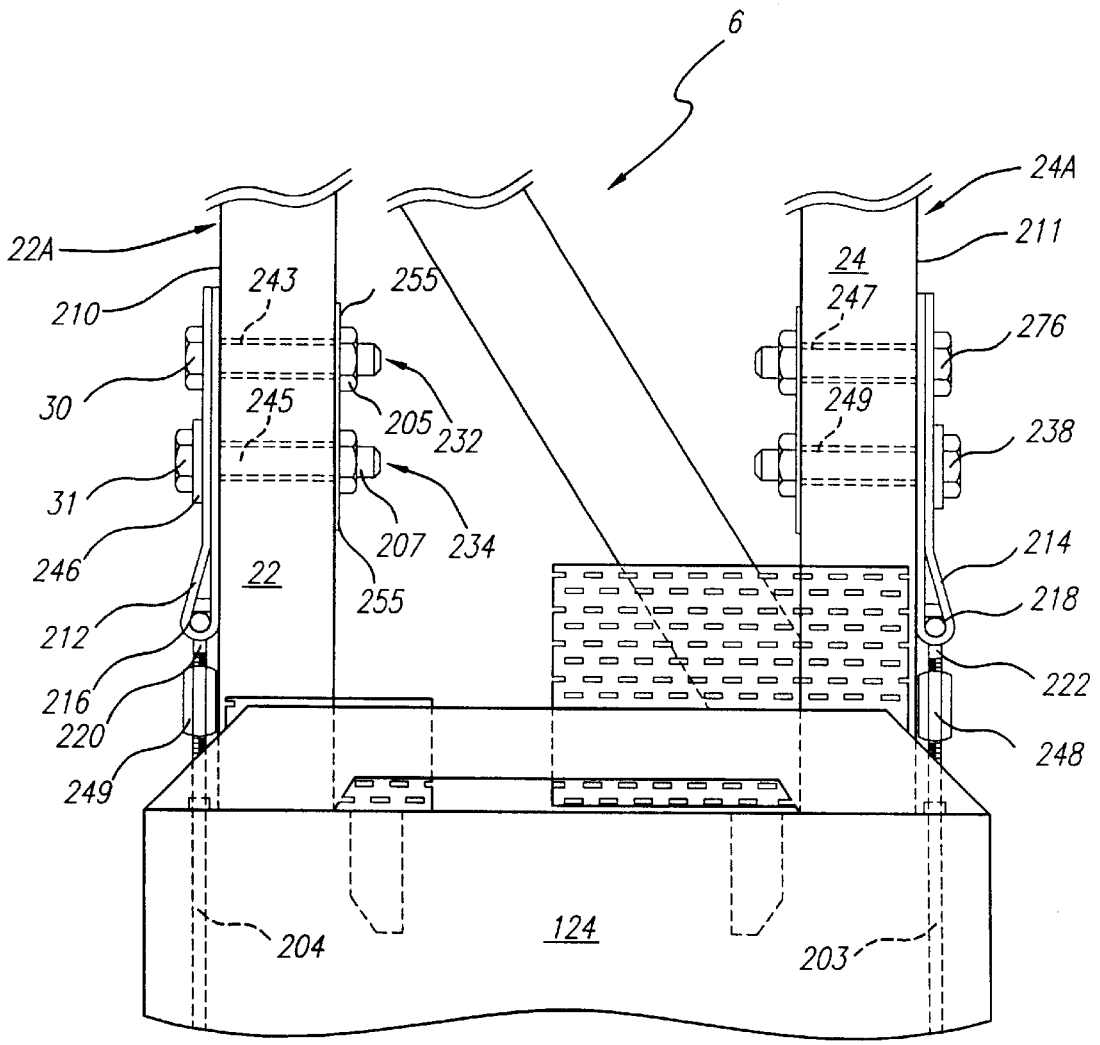
FIG. 13 is a detail view of the frame-foundation interface of FIG. 4.
Figure 14:
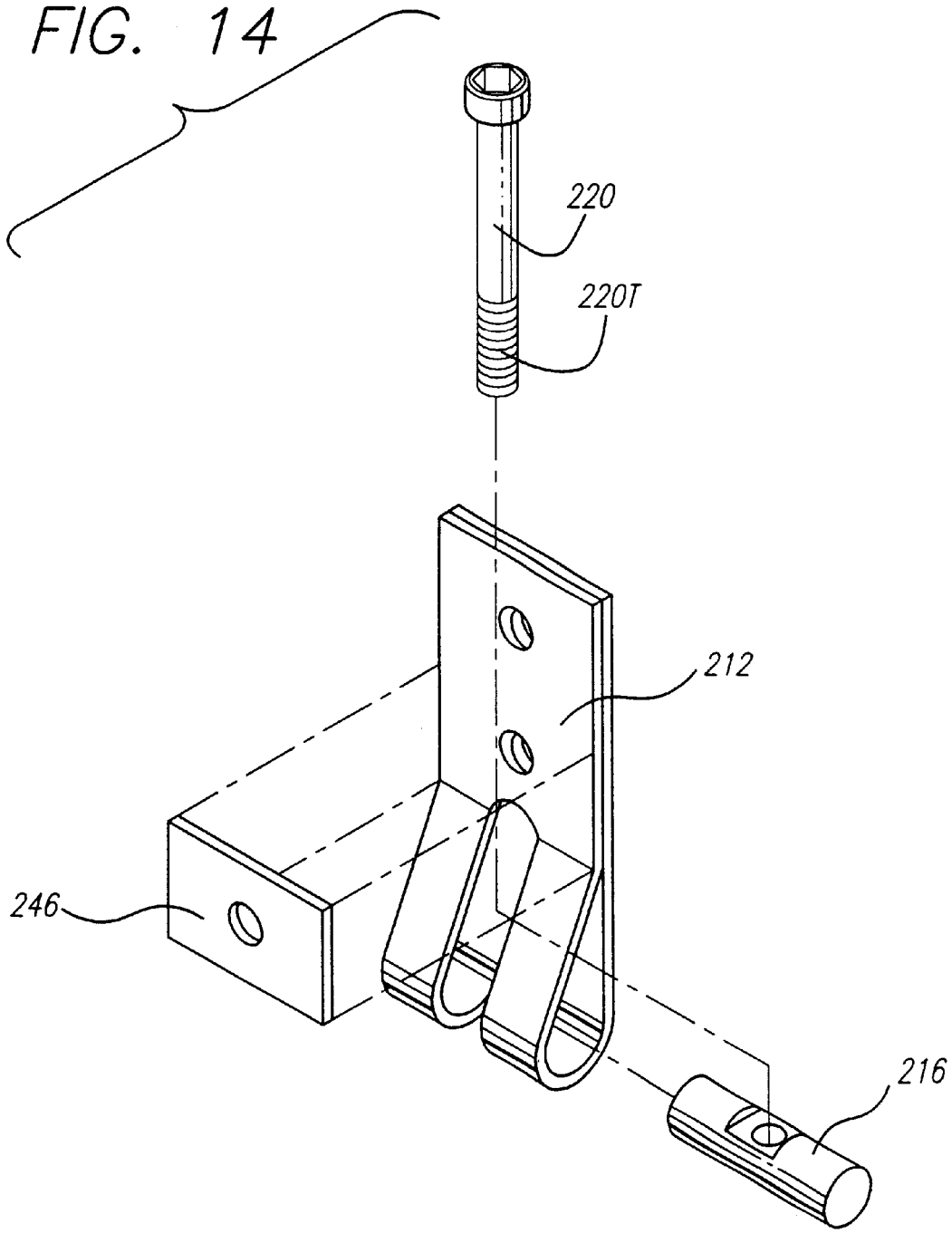
FIG. 14 is an exploded perspective view of the interconnection of some of the components of the holdown of FIG. 4.
Figure 16C:
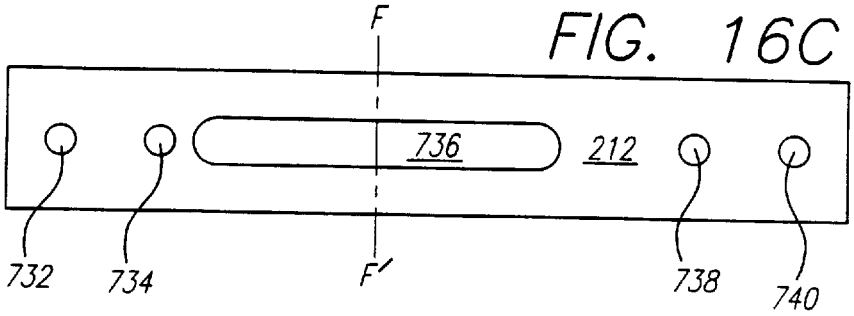
FIG. 16(*a*)–(*c*) are views of the currently preferred embodiment of a holdown strap according to the present invention.
Figure 16B:
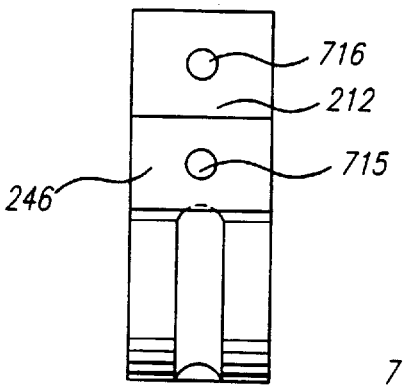
Figure 16A:
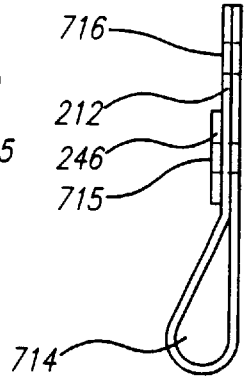

Referring now to FIG. 13 Rigid structural panel 2 is further secured to foundation 124 using holdowns such as holdown 6 and 8. In the currently preferred embodiment of the present invention, holdown straps 211 and 214 are folded metal strap of 3/16" steel, although any other suitable material may be used. Pin 216 and 218 fit within folded holdown straps 212 and 214 respectively. Holdown straps 211 and 214 are slotted, as shown in FIGS. 14 and 16(*a*)–(*c*), to accommodate holdown screws such as screws 220 and 222. Screws 220 and 222 extend perpendicular to the longitudinal axis of pins 216 and 218 respectively. The use of pins 216 and 218 and slots 212A and 214A permit screws 220 and 222 to rotate within the plane of rigid structural panel 2 and engage a holdown bolt that was not embedded perpendicular to the foundation. In a further aspect of the present invention, each holdown 6 and 8 is secured to rigid structural panel 2 using an upper bolt 30 and a lower bolt 31.

For first side member 22, upper bolt 31 penetrates holdown strap 212, first reinforcement plate 211, first side member 22, and sleeve 243. Threaded end 232 may be secured by nut 205 against a first plate washer 255. Lower holdown bolt 31 penetrates retaining plate 246, holdown strap 212, first reinforcement plate 211, side member 22, sleeve 245. Threaded end 234 may be secured by nut 207 against plate washer 255. Threaded end 220T of holdown screw 220 secures rigid structural panel 200 to foundation bolts such as bolts 203 and 204 by means of coupling nuts 248 and 249 which simultaneously engage holdown screw 222 and 220 and foundation bolt 203 and 204.

In another aspect of the present invention sleeves such as sleeve 243, 245, 247 and 249 are pressed through holes 9 in first side member 22 and second side member 24. The sleeves improve the load bearing capacity of side member 22 at the point of holdown attachment. The sleeves may be made of any rigid material, steel has proven to be the most effective yet tested. Exterior side member surfaces such as surface 22A and surface 24A which are penetrated by holes 9 are reinforced by having a reinforcing plate such as plate 210 and 211 pressed into the exterior surface of the side member over the location of holes 9. Teeth, such as tooth 705 in FIG. 15(*b*) secure reinforcing plates 210 and 211 to side member 22 and 24 respectively. Each reinforcing plate bolt hole 702 and 703 is concentric with imbedded sleeves such as sleeves 243 and 245 after sleeves 243 and 245 are pressed into a side member such as first side member 22. Reinforcing plates 210 and 211 prevent splitting of first side member 22 and second side member 24 when a load is applied to holdowns 6 and 8. Reinforcing plates 210 and 211 also prevent elongation of holes 9 by resisting shear applied by holdown 6 and 8 at surfaces 22A and 24A respectively. Central area 704 surrounds bolt holes 702 and 703 and is solid to improve the shear resistance and minimize hole elongation of reinforcing plates 210 and 211.

In the currently preferred embodiment of the present invention, holdown screws such as screw 220 are 5/8" steel capscrews having a tensile strength over 180,000 lbs. conforming to ASTM A574. Screw 220 is the principal means of transferring lateral loads to the foundation, therefore, the tensile strength may be selected for the maximum load expected.

Referring now to FIGS. 16(*a*)–(*c*), strap 710 is shown in detail. Folding strap 710 along F–F' forms a holdown such as holdown 6. Hole 732 is aligned with hole 740 and hole 734 is aligned with hole 738. Plate washer 712 is added for additional stability.

Figure 17A:
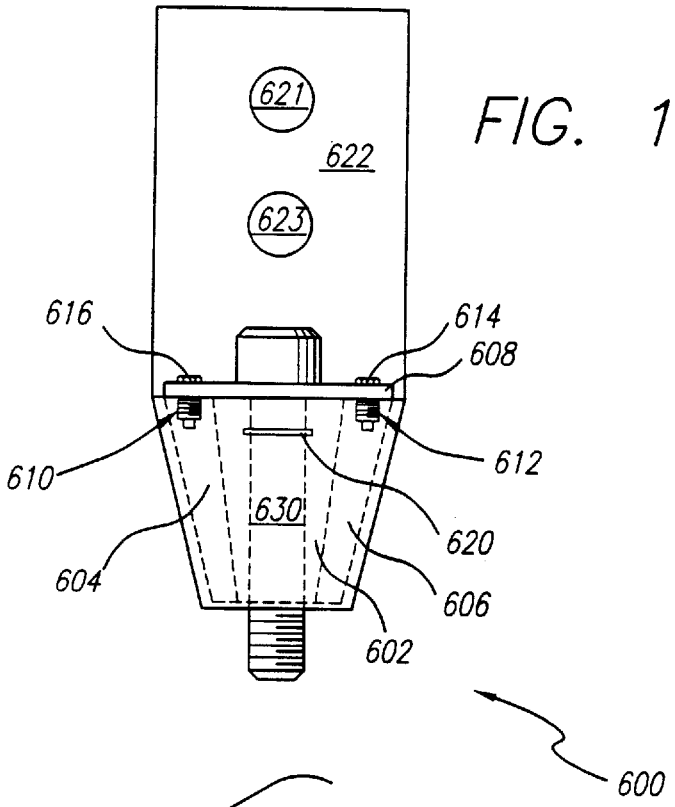
FIG. 17(*a*) is a front view of a self-tightening holdown according to the present invention.
Figure 17B:
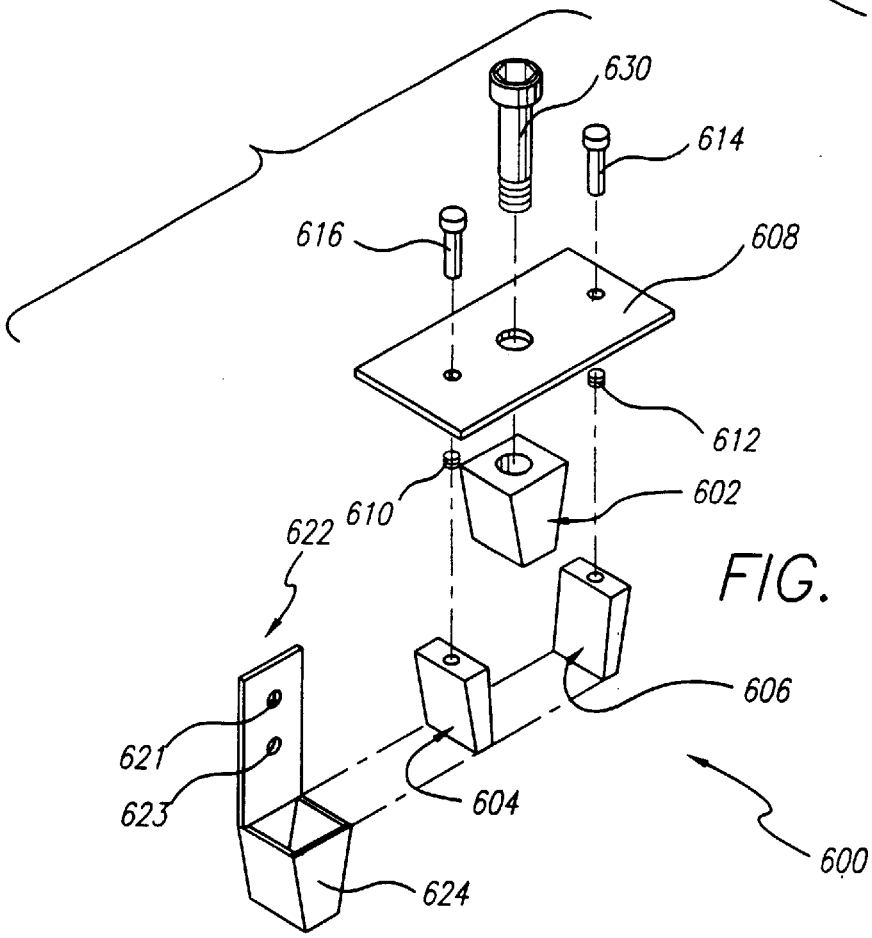

Referring now to FIGS. 17(*a*)–(*b*), self-tightening holdown 600 includes main wedge 602 and tightening wedges 604 and 606 within holdown pocket 624. Holster strap 622 is secured to a rigid structural panel or other structural element using holes 621 and 623. During installation, fasteners 614 and 616 secure plate 608 to tightening wedges 604 and 606 against the force of compression springs 610 and 612. After holdown 600 is installed, fasteners 614 and 616 are removed. Holdown screw 630 is attached to main wedge 602 by retaining clip 620. During cyclic lateral force loading, 59 relative movement between holster strap 622 and holdown screw 630 that causes holdown screw 630 and main wedge 602 to lift out of holdown pocket 624 allows springs 610 and 614 to push tightening wedges 604 and 606 deeper into holdown pocket 624. This self-tightening action minimizes the cyclic loosening effect of cyclic loading on the lateral force resisting system.

Figure 18:
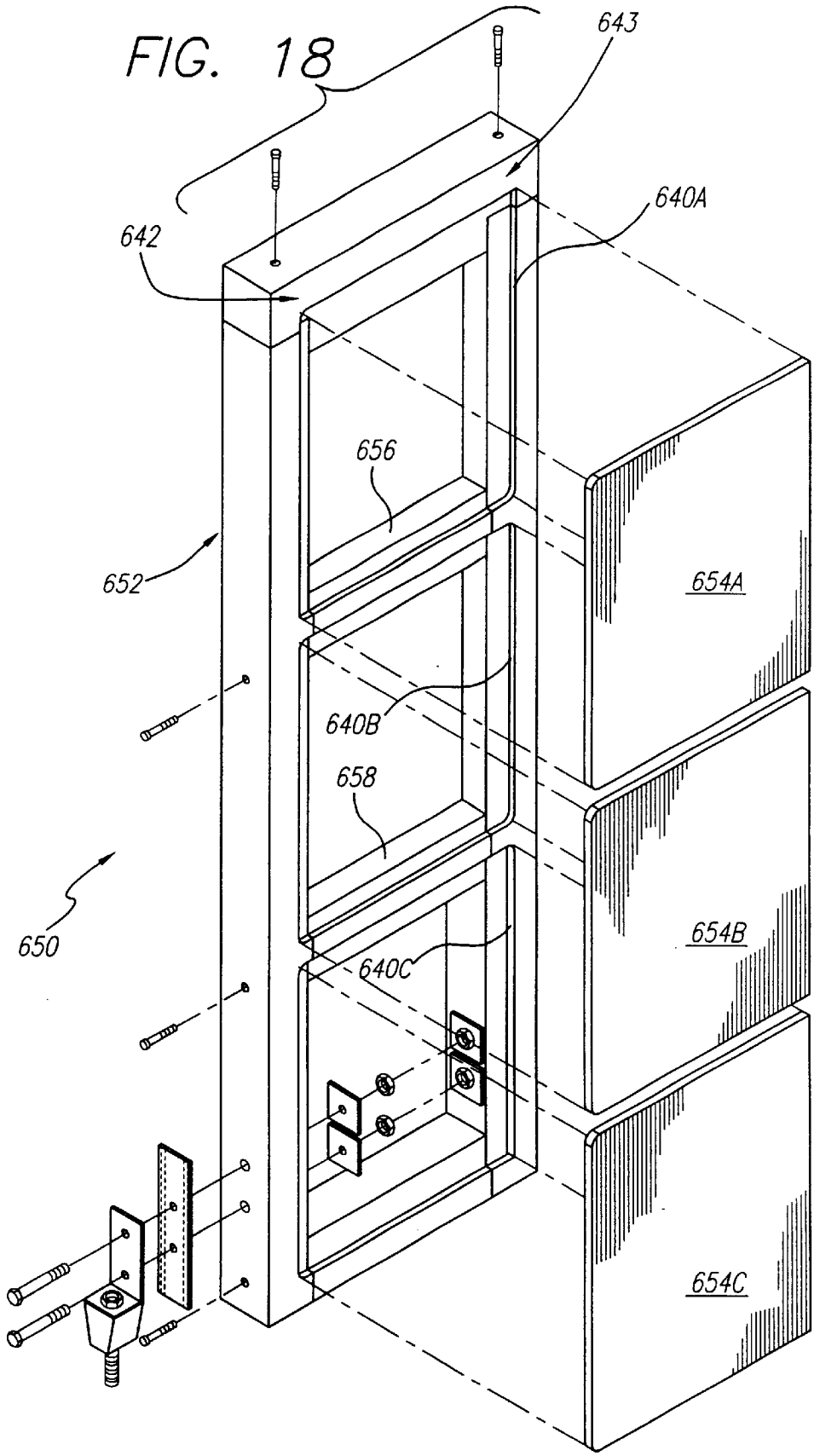
FIG. 18 is an exploded perspective view of another alternate embodiment of the present invention.

Referring now to FIG. 18, multi-pane panel 650 includes a plurality of panes 654A, 654B, and 654C vertically oriented in rigid structural frame 652 and horizontal members 656 and 658. This configuration permits more flexibility of the finished rigid structural panel under cyclic loads and yields more open load hysteresis curves. By using multiple vertically oriented panes the rigidity of multi-pane panel 650 may be tailored to meet specific needs. Vertically oriented panes may also be used in wide rigid structural panels such as rigid structural panel 300 and rigid structural panel 400. In a currently preferred embodiment of the present invention a rigid structural panel having vertically oriented panes, panes 654A, 654B, and 654C are oriented strand board (OSB) panes and are inset into dado 640A, 640B, and 640C respectively. Plates may be fastened over vertical joints 642 and 643 formed between panes 654A, 654B, and 654C and rigid structural frame 652 as discussed above.

Those skilled in the art will appreciate that the various adaptations and modifications of the just described preferred embodiment can be configured without departing from the scope and spirit of the invention. Therefore, it is to be understood that, within the scope of the appended claims, the invention may be practiced other than as specifically described herein.

We claim:

1. A device for securing a wall element of a wall to a foundation bolt comprising:

a folded strap having a long axis and a slot parallel to the long axis therethrough, the strap folded parallel to the long axis;

means for securing the strap to the wall element; and means for securing the strap to the foundation bolt in the plane of the wall at varying in-plane angles between the foundation bolt and the wall element.

2. A device for securing a wall element of a wall to a foundation bolt comprising:

a strap for attaching to the wall element;

means for securing the strap to the wall element;

a pin enclosed within a fold of the strap;

a bolt having a head end and a thread end, the bolt extending through the pin with the thread end extending beyond the strap; and a coupling nut for simultaneously engaging the thread end of the bolt and the foundation bolt.

* * * * *

UNITED STATES PATENT AND TRADEMARK OFFICE

CERTIFICATE OF CORRECTION

PATENT NO. : 6,244,004 B1
DATED : June 12, 2001
INVENTOR(S) : Timothy L. Timmerman et al.

It is certified that error appears in the above-identified patent and that said Letters Patent is hereby corrected as shown below:

Column 12,
Line 14, delete "59".

Signed and Sealed this

Fifth Day of March, 2002

*Attest:*

*Attesting Officer*

JAMES E. ROGAN
*Director of the United States Patent and Trademark Office*